US012096793B2

(12) United States Patent
Kim et al.

(10) Patent No.: US 12,096,793 B2
(45) Date of Patent: Sep. 24, 2024

(54) AEROSOL GENERATING ARTICLE COMPRISING TRIPLE CAPSULE AND AEROSOL GENERATING SYSTEM USING THE SAME

(71) Applicant: KT&G CORPORATION, Daejeon (KR)

(72) Inventors: Ick Joong Kim, Daejeon (KR); Ho Rim Song, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 763 days.

(21) Appl. No.: 17/265,240

(22) PCT Filed: Oct. 5, 2020

(86) PCT No.: PCT/KR2020/013512
§ 371 (c)(1),
(2) Date: Feb. 2, 2021

(87) PCT Pub. No.: WO2021/071185
PCT Pub. Date: Apr. 15, 2021

(65) Prior Publication Data

US 2022/0304379 A1 Sep. 29, 2022

(30) Foreign Application Priority Data

Oct. 11, 2019 (KR) ..... 10-2019-0126303

(51) Int. Cl.
*A24F 40/42* (2020.01)
*A24B 15/167* (2020.01)
(Continued)

(52) U.S. Cl.
CPC ..... *A24F 40/42* (2020.01); *A24B 15/167* (2016.11); *A24B 15/186* (2013.01);
(Continued)

(58) Field of Classification Search
CPC ..... A24F 40/42; A24F 40/20; A24F 40/10; A24F 40/40; A24B 15/167; A24B 15/186;
(Continued)

(56) References Cited

U.S. PATENT DOCUMENTS 9,167,848 B2 10/2015 Karles et al.
10,328,443 B2 6/2019 Ricketts et al.
(Continued)

FOREIGN PATENT DOCUMENTS

CN 103815542 A 5/2014
CN 204560971 U 8/2015
(Continued)

OTHER PUBLICATIONS

Office Action issued Apr. 10, 2023 in Chinese Application No. 202080005318.2.
(Continued)

*Primary Examiner* — Justin M Kratt
(74) *Attorney, Agent, or Firm* — Sughrue Mion, PLLC

(57) ABSTRACT

Provided are an aerosol generating article and an aerosol generating system using the same. The aerosol generating article includes a first portion containing a mouthpiece portion; and a second portion that is arranged adjacent to the first portion and includes a capsule, wherein the capsule includes a core region, a first shell, and a second shell, and the core region of the capsule includes nicotine and an aerosol generating material.

9 Claims, 10 Drawing Sheets

(51) Int. Cl.

| | |
|---|---|
| ***A24B 15/18*** | (2006.01) |
| ***A24B 15/28*** | (2006.01) |
| ***A24D 1/20*** | (2020.01) |
| ***A24F 40/20*** | (2020.01) |
| *A24B 3/12* | (2006.01) |
| *A24B 3/14* | (2006.01) |
| *A24B 15/00* | (2006.01) |
| *A24B 15/10* | (2006.01) |
| *A24B 15/12* | (2006.01) |
| *A24B 15/16* | (2020.01) |
| *A24B 15/30* | (2006.01) |
| *A24B 15/42* | (2006.01) |
| *A24F 40/10* | (2020.01) |
| *A24F 40/40* | (2020.01) |

(52) U.S. Cl.

CPC ..... *A24B 15/283* (2013.01); *A24D 1/20* (2020.01); *A24F 40/20* (2020.01); *A24B 3/12* (2013.01); *A24B 3/14* (2013.01); *A24B 15/00* (2013.01); *A24B 15/10* (2013.01); *A24B 15/12* (2013.01); *A24B 15/16* (2013.01); *A24B 15/18* (2013.01); *A24B 15/28* (2013.01); *A24B 15/281* (2013.01); *A24B 15/287* (2013.01); *A24B 15/30* (2013.01); *A24B 15/301* (2013.01); *A24B 15/302* (2013.01); *A24B 15/303* (2013.01); *A24B 15/305* (2013.01); *A24B 15/42* (2013.01); *A24F 40/10* (2020.01); *A24F 40/40* (2020.01)

(58) Field of Classification Search

CPC ..... A24B 15/283; A24B 3/12; A24B 3/14; A24B 15/00; A24B 15/10; A24B 15/12; A24B 15/16; A24B 15/18; A24B 15/28; A24B 15/281; A24B 15/287; A24B 15/30; A24B 15/301; A24B 15/302; A24B 15/303; A24B 15/305; A24B 15/42; A24D 1/20

See application file for complete search history.

(56) References Cited

U.S. PATENT DOCUMENTS

| | | | | |
|---|---|---|---|---|
| 10,660,368 | B2 | 5/2020 | Thorens | |
| 10,918,136 | B2 | 2/2021 | Reevell | |
| 2015/0313285 | A1 | 11/2015 | Waller et al. | |
| 2016/0157521 | A1 | 6/2016 | Woodcock et al. | |
| 2016/0235114 | A1 | 8/2016 | Liu et al. | |
| 2017/0265517 | A1 | 9/2017 | Swede et al. | |
| 2019/0174820 | A1* | 6/2019 | Wan | A24B 13/00 |
| 2019/0254345 | A1 | 8/2019 | Hepworth et al. | |
| 2020/0008462 | A1 | 1/2020 | Thorens | |

FOREIGN PATENT DOCUMENTS

| | | | | | |
|---|---|---|---|---|---|
| CN | 107361392 | A | * | 11/2017 | A23P 10/35 |
| CN | 108420110 | A | | 8/2018 | |
| CN | 109152408 | A | | 1/2019 | |
| CN | 109645561 | A | | 4/2019 | |
| CN | 109688854 | A | | 4/2019 | |
| EP | 3818839 | A1 | | 5/2021 | |
| JP | 2018-532399 | A | | 11/2018 | |
| JP | 2019-518444 | A | | 7/2019 | |
| JP | 2019-521650 | A | | 8/2019 | |
| KR | 10-2013-0029763 | A | | 3/2013 | |
| KR | 10-2015-0097579 | A | | 8/2015 | |
| KR | 10-1562648 | B1 | | 10/2015 | |
| KR | 10-2018-0021689 | A | | 3/2018 | |
| KR | 10-2019-0011724 | A | | 2/2019 | |
| WO | WO-2016161673 | A1 | * | 10/2016 | A24F 40/42 |

OTHER PUBLICATIONS

International Seach Report of PCT/KR2020/013512 dated Jan. 13, 2021 [PCT/ISA/210].

Extended European Search Report dated May 11, 2022 from the European Patent Office in EP Application No. 20841844.2.

Office Action dated May 17, 2022 from the Japanese Patent Office in JP Application No. 2021-507620.

Office Action dated Nov. 29, 2022 from the Japanese Patent Office in JP Application No. 2021-507620.

Office Action issued Feb. 21, 2024 in Chinese Application No. 202080005318.2.

* cited by examiner

AEROSOL GENERATING ARTICLE COMPRISING TRIPLE CAPSULE AND AEROSOL GENERATING SYSTEM USING THE SAME

CROSS REFERENCE TO RELATED APPLICATIONS

This application is a National Stage of International Application No. PCT/KR2020/013512, filed Oct. 5, 2020, claiming priority to Korean Patent Application No. 10-2019-0126303, filed Oct. 11, 2019.

TECHNICAL FIELD

One or more embodiments of the present disclosure relate to an aerosol generating article including a triple capsule and an aerosol generating system using the same.

BACKGROUND ART

Recently, the demand for alternative methods to overcome the shortcomings of general aerosol generating article has increased. For example, there is an increasing demand for a method of generating aerosol by heating an aerosol generating material in aerosol generating article, rather than by burning aerosol generating article. Accordingly, studies on a heating-type aerosol generating article or a heating-type aerosol generating device have been actively conducted.

In relation to the aerosol generating article including a capsule, Korean Patent Publication No. 10-2019-0011724 proposes a concept of an aerosol generating article including a capsule containing a liquid, but the capsule of the patent in question is a double capsule including a core-shell structure. In addition, since the core and the shell are both made of a water-soluble material, mechanical strength is not high enough, and thus the realization of the capsule is impossible.

DESCRIPTION OF EMBODIMENTS

Technical Problem

When the aerosol generating article according to the embodiment is applied, the above-described problems of the existing technology may be solved.

Additional aspects will be set forth in part in the description which follows and, in part, will be apparent from the description, or may be learned by the practice of the presented embodiments.

Solution to Problem

According to one aspect of the present disclosure, an aerosol generating article including an aerosol generating material includes: a first portion including a mouthpiece portion; and a second portion that is arranged adjacent to the first portion and includes a capsule, wherein the capsule includes a core region, a first shell, and a second shell, and the core region of the capsule includes nicotine and the aerosol generating material.

Advantageous Effects of Disclosure

An aerosol generating article according to an embodiment may crush a capsule containing a liquid, support the liquid on a carrier, and heat the liquid to generate an aerosol.

In addition, the aerosol generating article according to the embodiment includes a triple capsule manufactured through coextrusion so as to effectively include a liquid containing nicotine and an aerosol generating material therein.

Moreover, the triple capsule of the aerosol generating article according to the embodiment includes a vegetable wax component, and thus there is an advantage in that off-flavor is not generated when the aerosol generating article is heated using an aerosol generating device.

The effects of the present disclosure are not limited to those described above, and may include all effects that may be inferred from the configuration described later.

BEST MODE

Figure 1:
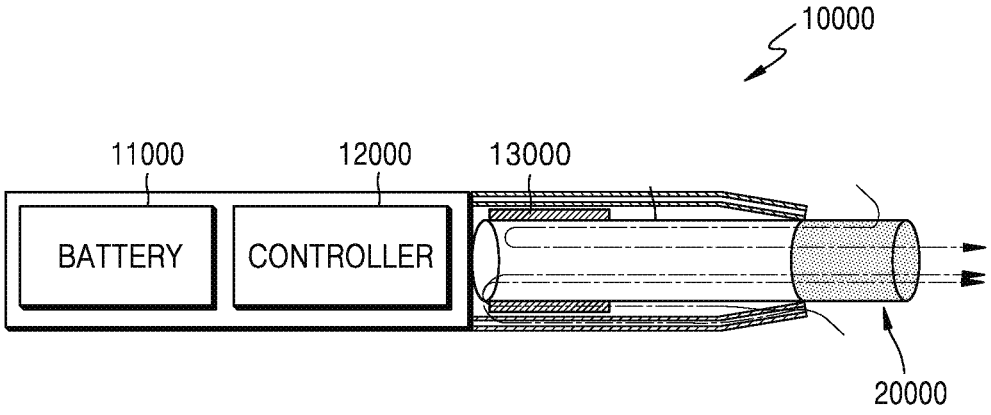
FIG. 1 is a diagram illustrating a case where an aerosol generating article is inserted into an aerosol generating device, according to an embodiment.

According to one aspect of the present disclosure, an aerosol generating article including an aerosol generating material includes: a first portion including a mouthpiece portion; and a second portion that is arranged adjacent to the first portion and includes a capsule, wherein the capsule includes a core region, a first shell, and a second shell, and the core region of the capsule includes nicotine and the aerosol generating material.

According to embodiments, the aerosol generating article may further include a carrier arranged within the second portion and arranged adjacent to the capsule.

According to embodiments, the capsule is formed in a triple structure of a core region, a first shell, and a second shell in order from the inside, and the first shell may include a fat-soluble vegetable wax, and the second shell may include a water-soluble polymer.

According to embodiments, the first shell may include a fat-soluble wax having a melting point of 30° C. to 60° C., and the second shell may include a water-soluble polymer having a gelation temperature of 40° C. to 55° C.

According to embodiments, the first shell may include one or more of carnauba wax, candelilla wax, castor wax, feather palm wax, cocoa butter, and shea butter, and the second shell may include gelatin, agar, carrageenan, gellan gum, pectin, starch, or alginate.

According to embodiments, the core region may have a diameter of 2.5 mm to 6.0 mm, the first shell may have a thickness of 0.1 mm to 1.0 mm, and the second shell may have a thickness of 0.001 mm to 1.5 mm.

According to embodiments, the core region may include 30 parts to 70 parts by weight of propylene glycol, 30 parts to 70 parts by weight of glycerin, and 0.1 parts to 5 parts by weight of nicotine, based on 100 parts by weight of a total composition.

According to embodiments, a diameter of the capsule may be 2.6 mm to 8.5 mm, and a crushing strength of the capsule may be 0.5 kgf to 3.0 kgf.

According to another aspect of the present disclosure, a system generates an aerosol by heating an aerosol generating article using an aerosol generating device, wherein the aerosol generating article includes: a first portion including a mouthpiece portion; and a second portion that is arranged adjacent to the first portion and includes a capsule. The capsule includes a core region, a first shell, and a second shell, wherein the core region of the capsule includes nicotine and an aerosol generating material. The aerosol generating device heats at least a portion of the second portion to generate an aerosol.

According to embodiments, after the capsule is crushed, the aerosol generating device may heat at least a portion of the second portion to generate an aerosol.

According to another aspect of the present disclosure, provided is a triple capsule manufactured by a method comprising: (a) supplying an interior material, an intermediate layer material, and an exterior layer material; (b) receiving the interior material, the intermediate layer material, and the exterior layer material through a nozzle mount and discharging a triple molded body by coextruding the interior material, the intermediate layer material, and the exterior layer material through a triple nozzle in which a first nozzle discharging the interior material, a second nozzle discharging the intermediate layer material, and a third nozzle discharging the exterior layer material are concentrically arranged; and (c) forming the triple capsule by circulating a coolant to cool the triple molded body.

According to embodiments, the intermediate layer material may include a fat-soluble wax having a melting point of 30° C. to 60° C., and the exterior layer material may include a water-soluble polymer having a gelation temperature of 40° C. to 55° C.

Embodiments of the present disclosure are not limited thereto. It is to be appreciated that what is apparent to those skilled in the art from the detailed descriptions and embodiments will be construed as being included in the scope of protection defined by the claims.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, "A and/or B" refers to at least one of A and B.

Throughout the specification, "on ~" refers to that a member is disposed on one surface of another member, and includes all cases in which a member is disposed in contact with or without contact with another member.

Throughout the specification, a "polymer" refers to a compound in which a plurality of unit structures are repeated.

Throughout the specification, a "core-shell structure" refers to a structure in which a core is disposed in a center and a shell surrounds the core. Here, the shell may be arranged to surround all or part of the core.

Throughout the specification, a "gelation temperature" refers to a temperature at which a substance transforms from a sol state to a gel state.

Hereinafter, embodiments of the present disclosure will be described in detail with reference to the accompanying drawings.

Figure 2:
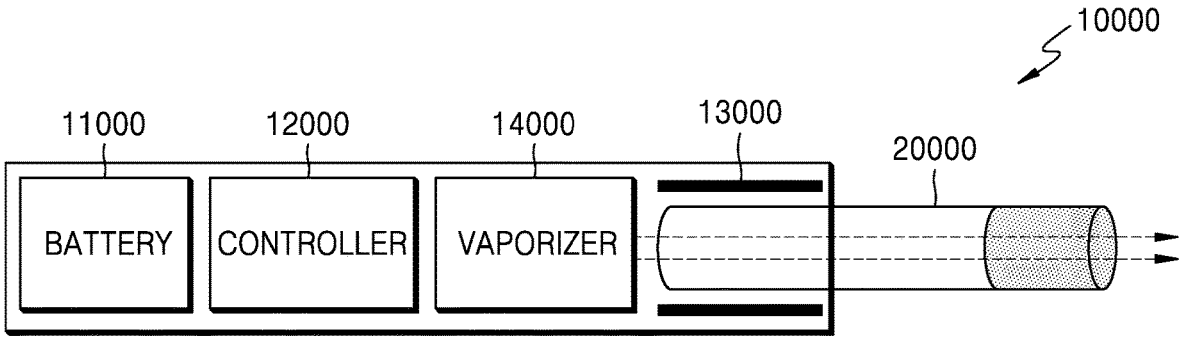
FIG. 2 is a diagram illustrating a case where an aerosol generating article is inserted into an aerosol generating device, according to another embodiment.
Figure 3:
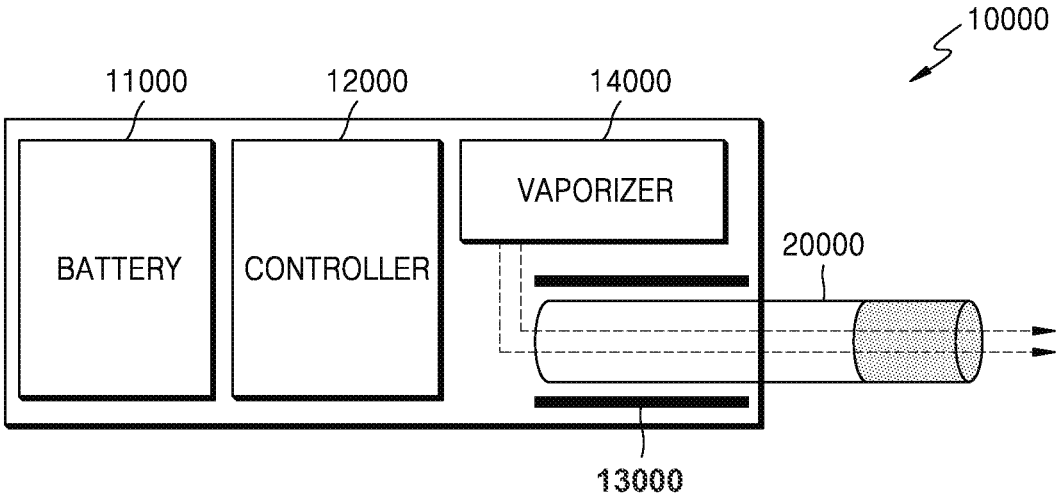
FIG. 3 is a diagram illustrating a case where an aerosol generating article is inserted into an aerosol generating device, according to another embodiment.

FIGS. 1 through 3 are diagrams showing examples in which an aerosol generating article 20000 is inserted into an aerosol generating device 10000.

Referring to FIG. 1, the aerosol generating device 10000 may include a battery 11000, a controller 12000, and a heater 13000. Referring to FIGS. 2 and 3, the aerosol generating device 10000 may further include a vaporizer 14000. Also, the aerosol generating article 20000 may be inserted into an inner space of the aerosol generating device 10000.

FIGS. 1 through 3 illustrate components of the aerosol generating device 10000, which are related to the present embodiment. Therefore, it will be understood by one of ordinary skill in the art related to the present embodiment that other general-purpose components may be further included in the aerosol generating device 10000, in addition to the components illustrated in FIGS. 1 through 3.

Also, FIGS. 2 and 3 illustrate that the aerosol generating device 10000 includes the heater 13000. However, according to necessity, the heater 13000 may be omitted.

FIG. 1 illustrates that the battery 11000, the controller 12000, and the heater 130000 are arranged in series. Also, FIG. 2 illustrates that the battery 11000, the controller 12000, the vaporizer 14000, and the heater 13000 are arranged in series. Also, FIG. 3 illustrates that the vaporizer 14000 and the heater 13000 are arranged in parallel. However, the internal structure of the aerosol generating device 10000 is not limited to the structures illustrated in FIGS. 1 through 3. In other words, according to the design of the aerosol generating device 10000, the battery 11000, the controller 12000, the heater 13000, and the vaporizer 14000 may be differently arranged.

When the aerosol generating article 20000 is inserted into the aerosol generating device 10000, the aerosol generating device 10000 may operate the heater 13000 and/or the vaporizer 14000 to generate an aerosol from the aerosol generating article 20000 and/or the vaporizer 14000. The aerosol generated by the heater 13000 and/or the vaporizer 14000 is delivered to a user by passing through the aerosol generating article 20000.

According to necessity, even when the aerosol generating article 20000 is not inserted into the aerosol generating device 10000, the aerosol generating device 10000 may heat the heater 13000.

The battery 11000 may supply power to be used for the aerosol generating device 10000 to operate. For example, the battery 11000 may supply power to heat the heater 13000 or the vaporizer 14000, and may supply power for operating the controller 12000. Also, the battery 11000 may supply power for operations of a display, a sensor, a motor, etc. mounted in the aerosol generating device 10000.

The controller 12000 may generally control operations of the aerosol generating device 10000. In detail, the controller 12000 may control not only operations of the battery 11000, the heater 13000, and the vaporizer 14000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13000 may be heated by the power supplied from the battery 11000. For example, when the aerosol generating article 20000 is inserted into the aerosol generating device 10000, the heater 13000 may be located outside the aerosol generating article 20000. Thus, the heated heater 13000 may increase a temperature of an aerosol generating material in the aerosol generating article 20000.

The heater 13000 may include an electro-resistive heater. For example, the heater 13000 may include an electrically conductive track, and the heater 13000 may be heated when currents flow through the electrically conductive track. However, the heater 13000 is not limited to the example described above and may include all heaters which may be heated to a desired temperature. Here, the desired temperature may be pre-set in the aerosol generating device 10000 or may be set as a temperature desired by a user.

As another example, the heater 13000 may include an induction heater. In detail, the heater 13000 may include an electrically conductive coil for heating a cigarette in an induction heating method, and the cigarette may include a susceptor which may be heated by the induction heater.

For example, the heater 13000 may include a tube-type heating element, a plate-type heating element, a needle-type heating element, or a rod-type heating element, and may heat the inside or the outside of the aerosol generating article 20000, according to the shape of the heating element.

Also, the aerosol generating device 10000 may include a plurality of heaters 13000. Here, the plurality of heaters 13000 may be inserted into the aerosol generating article 20000 or may be arranged outside the aerosol generating article 20000. Also, some of the plurality of heaters 13000 may be inserted into the aerosol generating article 20000 and the others may be arranged outside the aerosol generating article 20000. In addition, the shape of the heater 13000 is not limited to the shapes illustrated in FIGS. 1 through 3 and may include various shapes.

The vaporizer 14000 may generate an aerosol by heating a liquid composition and the generated aerosol may pass through the aerosol generating article 20000 to be delivered to a user. In other words, the aerosol generated via the vaporizer 14000 may move along an air flow passage of the aerosol generating device 10000 and the air flow passage may be configured such that the aerosol generated via the vaporizer 14000 passes through the aerosol generating article 20000 to be delivered to the user.

For example, the vaporizer 14000 may include a liquid storage, a liquid delivery element, and a heating element, but it is not limited thereto. For example, the liquid storage, the liquid delivery element, and the heating element may be included in the aerosol generating device 10000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached/detached to/from the vaporizer 14000 or may be formed integrally with the vaporizer 14000.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14000 may be referred to as a cartomizer or an atomizer, but it is not limited thereto.

The aerosol generating device 10000 may further include general-purpose components in addition to the battery 11000, the controller 12000, the heater 13000, and the vaporizer 14000. For example, the aerosol generating device 10000 may include a display capable of outputting visual information and/or a motor for outputting haptic information. Also, the aerosol generating device 10000 may include at least one sensor (a puff detecting sensor, a temperature detecting sensor, an aerosol generating article insertion detecting sensor, etc.). Also, the aerosol generating device

10000 may be formed as a structure where, even when the aerosol generating article 20000 is inserted into the aerosol generating device 10000, external air may be introduced or internal air may be discharged.

Although not illustrated in FIGS. 1 through 3, the aerosol generating device 10000 and an additional cradle may form together a system. For example, the cradle may be used to charge the battery 11000 of the aerosol generating device 10000. Alternatively, the heater 13000 may be heated when the cradle and the aerosol generating device 10000 are coupled to each other.

A second portion of the aerosol generating article may be inserted into the aerosol generating device 10000, and a first portion of the aerosol generating article may be exposed to the outside. Alternatively, a portion of the second portion of the aerosol generating article may be inserted into the aerosol generating device 10000, and all of the second portion and a portion of the first portion of the aerosol generating article may be inserted into the aerosol generating device 10000. A user may inhale the aerosol by biting the first portion of the aerosol generating article. In that case, the aerosol may be generated when air from the outside passes through the second portion of the aerosol generating article, and the generated aerosol may pass through the first portion of the aerosol generating article and be delivered to the user's mouth.

As an example, air from the outside may flow in through at least one air passage formed within the aerosol generating device 10000. For example, opening and closing of the air passage formed within the aerosol generating device 10000 and/or a size of the air passage may be regulated by the user. Therefore, atomization and smoking taste may be adjusted by the user. As another example, air from the outside may flow into the aerosol generating article 20000 through at least one hole formed on a surface of the aerosol generating article 20000.

Figure 4:
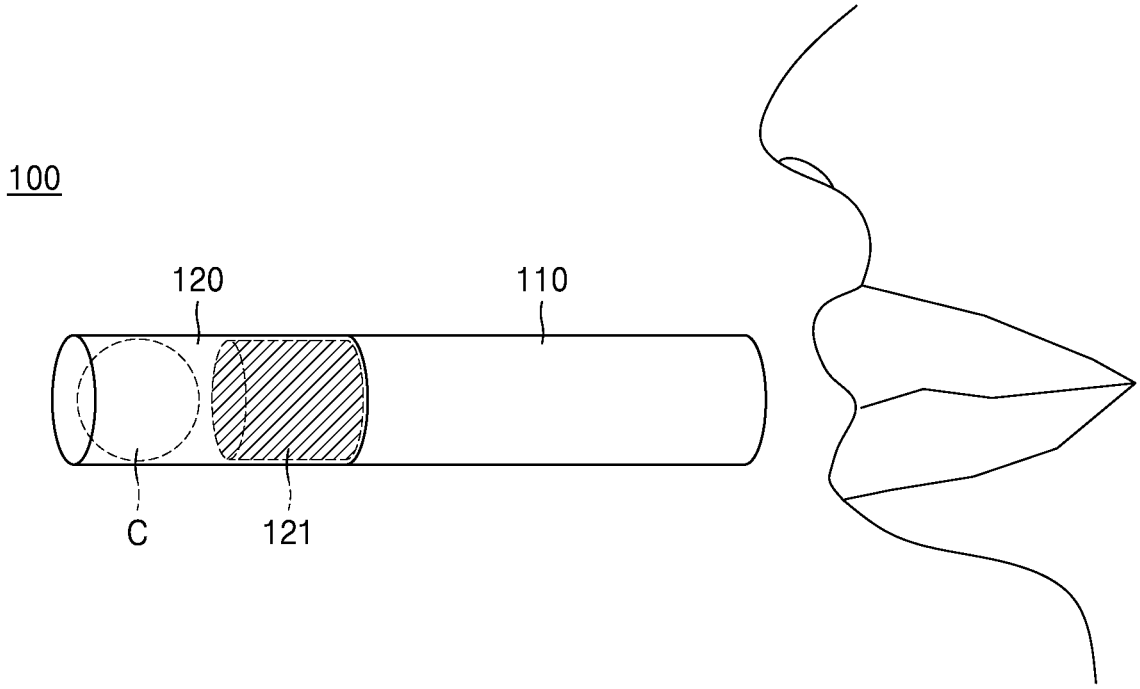
FIG. 4 is a diagram illustrating an aerosol generating article, according to an embodiment.

FIG. 4 is a diagram illustrating an aerosol generating article 100, according to an embodiment.

The aerosol generating article 100 according to an embodiment may include: a first portion 110 including a mouthpiece portion; and a second portion that is arranged adjacent to the first portion 110 and includes a capsule C.

The first portion 110 may be, for example, a cellulose acetate filter, and may be a cylindrical rod. Still, the shape of the first portion 110 is not limited thereto, and the first portion 110 may be a tubular rod or a recessed rod including a hollow therein. If the first portion 110 includes a plurality of segments, the plurality of segments may be manufactured in shapes different from each other. For example, the first portion 110 may include a cooling segment including a tube filter or a branch pipe filter, and a mouthpiece segment. However, embodiments of the present disclosure are not limited thereto.

At least a portion of the first portion 110 may be manufactured to generate flavor. As an example, a fragrance liquid may be sprayed onto the first portion 110, or a separate fiber coated with the fragrance liquid may be inserted into the first portion 110.

The second portion 120 may include the capsule C, and may further include a carrier 121 arranged adjacent to the capsule C. As shown in FIG. 4, the capsule C and the carrier 121 may be arranged side by side, the capsule C may be arranged at an end of the aerosol generating article 100, and the carrier 121 may be arranged within the second portion 120 arranged adjacent to the first portion 110 of aerosol generating article 100. However, embodiments of the present disclosure are not limited thereto. Still, since the capsule C and the carrier 121 of the aerosol generating article 100 have such an arrangement, when an aerosol generating article according to an embodiment is inserted into an aerosol generating device (not shown), the aerosol generating device may effectively heat the carrier 121 of the second portion 120.

The capsule C may have a triple capsule structure, and may include nicotine and an aerosol generating material. The capsule C may be destroyed by external force or heat to release nicotine and an aerosol generating material from the inside. The aerosol generating material may include at least one of glycerin, propylene glycol, ethylene glycol, dipropylene glycol, diethylene glycol, triethylene glycol, tetraethylene glycol, and oleyl alcohol. An external force may be, for example, a force generated by a smoker's hand or mouth, but is not particularly limited thereto. The capsule C will be described in greater detail in FIG. 6 below.

The carrier 121 may function to support the nicotine and the aerosol generating material released from the capsule C. For example, the carrier 121 may include a cellulose acetate material, like the first portion 110. Still, it is not particularly limited thereto, and any known material that functions to support a liquid may be used as the carrier 121 without limitation.

Although not shown, the aerosol generating article 100 according to an embodiment may further include a third portion (not shown) arranged adjacent to the second portion 120. For example, the third portion may be arranged at an extreme end of the aerosol generating article 100 as a tube-shaped plug, and by regulating a length corresponding to the third portion, a portion in which the aerosol generating article 100 is directly heated by the aerosol generating device (not shown) may be appropriately adjusted.

Figure 5:
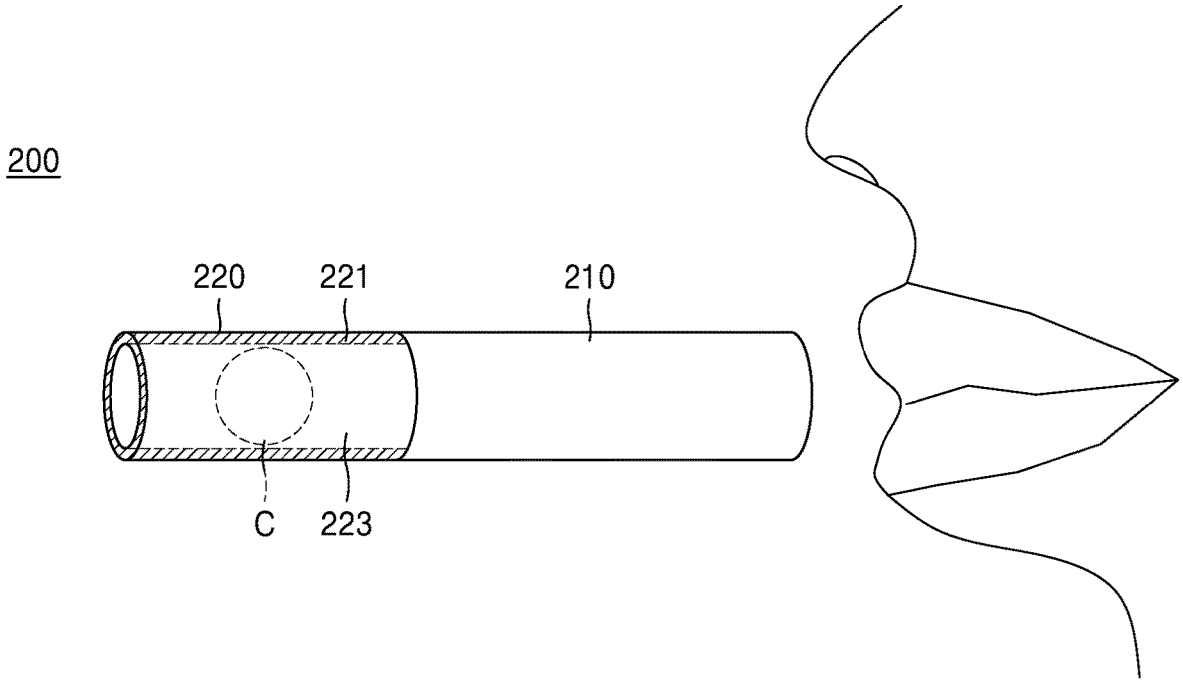
FIG. 5 is a diagram illustrating an aerosol generating article, according to another embodiment.

FIG. 5 is a diagram illustrating an aerosol generating article 200 including a first portion 210 and a second portion 220, according to another embodiment.

The components described in FIG. 4 may be equally applied to FIG. 5. Still, unlike FIG. 4, structures of the capsule C and a carrier 221 arranged within a second portion 220 of the aerosol generating article 200 may be changed in FIG. 5.

For example, the second portion 220 may include the carrier 221 formed toward the outside and a cavity 223 formed toward the inside, based on a cross section. The capsule C may be arranged within the cavity 223. An end of the second portion 220 may be open as shown in FIG. 5. However, it is not particularly limited thereto, and the end of the second portion 220 may be closed by the carrier 221 formed to extend, and the closed end of the second portion 220 may protect the capsule C.

When the capsule C is crushed by an external force, the nicotine and the aerosol generating material released from the inside may be supported on the carrier 221 formed toward the outside, based on the cross-section of the second portion 220. When the aerosol generating article 200 is inserted into an aerosol generating device (not shown) and heated, an aerosol may be generated as heat is transferred to the aerosol generating material.

Figure 6:
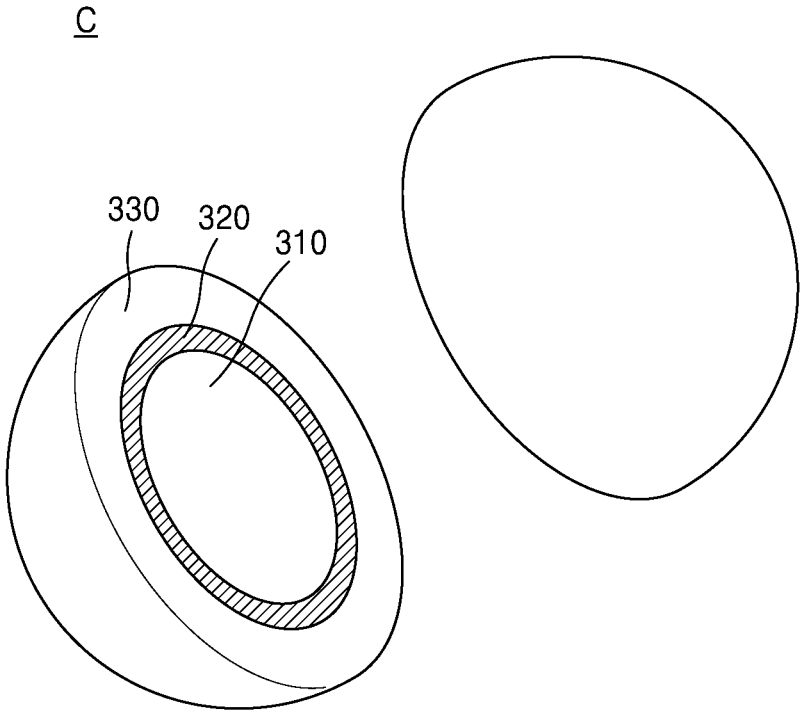
FIG. 6 is a diagram illustrating a capsule included in an aerosol generating article, according to an embodiment.

FIG. 6 is a diagram illustrating the capsule C included in an aerosol generating article, according to an embodiment. According to an embodiment, the capsule C may include a core region 310, a first shell 320, and a second shell 330. The core region 310 of the capsule C may include nicotine and an aerosol generating material.

FIG. 6 illustrates that the capsule C has a spherical shape. However, embodiments of the present disclosure are not limited thereto. A cross section of the capsule C may have a locally elliptical or a partially deformed circular shape.

The capsule C may be formed in a triple structure in which the core region 310, the first shell 320, and the second shell 330 are arranged in order from the inside, and materials that each region includes may be different from each other. For example, the first shell 320 may include a fat-soluble vegetable wax, and the second shell 330 may include a water-soluble polymer.

The core region 310 may have a diameter of about 2.5 mm to about 6.0 mm, the first shell 320 may have a thickness of about 0.1 mm to about 1.0 mm, and the second shell 330 may have a thickness of about 0.001 mm to about 1.5 mm. For example, the second shell 330 may have a thickness of about 0.3 mm to about 1.5 mm before moisture disappears, and the second shell 330 may have a thickness of about 0.001 mm to about 0.05 mm after moisture disappears. However, it is not particularly limited thereto, and the numerical range may be appropriately adjusted at a level that may be easily changed by a person skilled in the art.

The core region 310 may contain one or more of propylene glycol, glycerin, and nicotine. In addition, the core region 310 may further contain an organic acid to help the activity of nicotine. However, embodiments of the present disclosure are not limited thereto.

More specifically, the core region 310 may include about 30 parts to about 70 parts by weight of propylene glycol, about 30 parts to about 70 parts by weight of glycerin, and about 0.1 parts to about 5 parts by weight of nicotine, based on 100 parts by weight of a total composition. It is desirable that the core region 310 include about 40 parts to about 50 parts by weight of propylene glycol, about 40 parts to about 50 parts by weight of glycerin, about 0.3 parts to about 5 parts by weight of nicotine, and about 0.1 parts to about 5 parts by weight of an organic acid.

According to an embodiment, the first shell 320 may include a fat-soluble wax having a melting point of about 30° C. to about 60° C., and the second shell 330 may include a water-soluble polymer having a gelation temperature of about 40° C. to about 55° C. More specifically, the first shell 320 may have a melting point of about 30° C. to about 60° C., about 30° C. to about 50° C., about 30° C. to about 40° C., about 40° C. to about 60° C., about 40° C. to about 50° C., or about 50° C. to about 60° C. The second shell 330 may have a melting point of about 45° C. to about 55° C., about 45° C. to about 50° C., or about 50° C. to about 55° C.

When the melting point of the fat-soluble wax used as a material of the first shell 320 is less than 30° C., the capsule C may be easily broken during storage, and when the melting point of the fat-soluble wax exceeds 60° C., mechanical strength of the capsule C is high and accordingly, the capsule C is not crushed by an external force or heat, and therefore, the nicotine and the aerosol generating material may not leak out.

In addition, since the melting point of the fat-soluble wax used as a material of the first shell 320 is relatively low, such as about 60° C. or less, a triple molded body co-extruded from a nozzle, as described below, may be uniformly cooled within a relatively close temperature range. Therefore, the first shell 320 and the second shell 330 may be formed together to have an appropriate mechanical strength, and the manufacturing yield of the capsule C may be increased.

The first shell 320 may include a vegetable wax. The vegetable wax may include, for example, carnauba wax, candelilla wax, castor wax, and feather palm wax. According to a preferred embodiment, the first shell 320 may include cocoa butter or shea butter. The first shell 320 may be manufactured by mixing any one or at least two or more of the above-described vegetable waxes. When two or more of the above-described vegetable waxes are mixed to produce the first shell 320, the melting point of the first shell 320 may be appropriately changed according to the physical properties of the mixed vegetable waxes. When the first shell 320 includes the vegetable waxes as described above, off-flavor generated when the capsule C is heated by an aerosol generating device (not shown) may be reduced.

In addition, the first shell 320 may further include an additive so that the melting point and mechanical properties may be improved. According to a preferred embodiment, the additive may be a fatty acid, and the fatty acid may include at least one of palmitic acid, stearic acid, and myristic acid, but is not limited thereto.

The second shell 330 may include a water-soluble polymer. The second shell 330 is formed on an outermost side of the capsule C, and may have characteristics related to the crushing of the capsule C. In order to prevent the capsule C from being crushed inadvertently, the second shell 330 may be formed of a material having elasticity or flexibility. The second shell 330 may include, for example, at least one of water-soluble hydrocolloids such as gelatin, agar, carrageenan, alginic acid, pectin, etc, gums such as gellan gum, etc, starches such as potato starch, corn starch, etc, and a starch derivative such as dextrin, maltodextrin, cyclodextrin, etc. In addition, the second shell 330 may include a cellulose derivative such as hydroxy propyl methyl cellulose (HPMC), hydroxy propyl cellulose (HPC), methyl cellulose (MC), carboxy methyl cellulose (CMC), polyvinyl alcohol, and polyol.

According to an embodiment, a total diameter of the capsule C may be about 2.6 mm to about 8.5 mm. More specifically, the total diameter of the capsule C may be in a range of about 2.6 mm to about 8.5 mm, about 2.6 mm to about 7.5 mm, about 2.6 mm to about 6.5 mm, about 2.6 mm to about 5.5 mm, about 2.6 mm to about 4.5 mm, about 2.6 mm to about 3.5 mm, about 2.6 mm to about 3.0 mm, about 3.0 mm to about 8.5 mm, about 3.0 mm to about 7.5 mm, about 3.0 mm to about 6.5 mm, about 3.0 mm to about 5.5 mm, about 3.0 mm to about 4.5 mm, about 3.0 mm to about 3.5 mm, about 3.5 mm to about 8.5 mm, about 3.5 mm to about 7.5 mm, about 3.5 mm to about 6.5 mm, about 3.5 mm to about 5.5 mm, about 3.5 mm to about 4.5 mm, about 4.5 mm to about 8.5 mm, about 4.5 mm to about 7.5 mm, about 4.5 mm to about 6.5 mm, about 4.5 mm to about 5.5 mm, about 5.5 mm to about 8.5 mm, about 5.50 mm to about 7.5 mm, about 5.5 mm to about 6.5 mm, about 6.5 mm to about 8.5 mm, about 6.5 mm to about 7.5 mm, or about 7.5 mm to about 8.5 mm. Still, a diameter of the capsule C may be appropriately changed within a range that may be included within a diameter of the aerosol generating article.

According to an embodiment, a crushing strength of the capsule C may be about 0.5 kgf to about 3.0 kgf. More specifically, the crushing strength of the capsule C may be within a range of about 0.5 kgf to about 3.0 kgf, about 0.5 kgf to about 2.5 kgf, about 0.5 kgf to about 2.0 kgf, about 0.5 kgf to about 1.5 kgf, about 0.5 kgf to about 1.0 kgf, about 1.0 kgf to about 3.0 kgf, about 1.0 kgf to about 2.5 kgf, about 1.0 kgf to about 2.0 kgf, about 1.0 kgf to about 1.5 kgf, about 1.5 kgf to about 3.0 kgf, about 1.5 kgf to about 2.5 kgf, about 1.5 kgf to about 2.0 kgf, about 2.0 kgf to about 3.0 kgf, about 2.0 kgf to about 2.5 kgf, or about 2.5 kgf to about 3.0 kgf. Still, the crushing strength of the capsule C may be appropriately changed by a person skilled in the art within a range in which the capsule C may be crushed by an external force.

Figure 7:
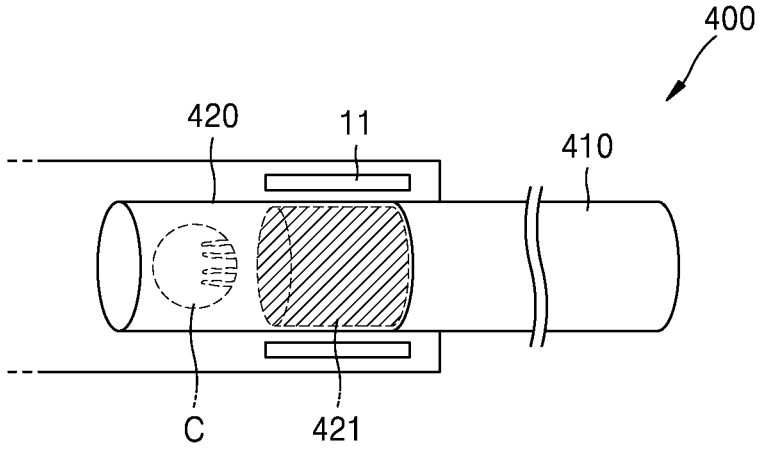
FIG. 7 is a diagram illustrating a case where an aerosol generating article is inserted into an aerosol generating device, according to an embodiment.

FIG. 7 is a diagram illustrating a case where an aerosol generating article 400 is inserted into an aerosol generating device 10, according to an embodiment. In that case, the capsule C may be arranged at an end of the aerosol generating article 400 in a crushed state, and nicotine and an aerosol generating material contained in a core region of the crushed capsule C may leak out and be supported on a carrier 421.

According to an embodiment, the aerosol generating device 10 may include a heating element 11, as described in FIGS. 1 to 3. The heating element 11 may be arranged to surround an accommodation space (not shown) in which the aerosol generating article 400 is accommodated within the aerosol generating device 10. The heating element 11 may be, for example, in the shape of a cylinder surrounding the accommodation space. However, embodiments of the present disclosure are not limited thereto.

According to an embodiment, the heating element 11 may be arranged to cover at least a portion of a second portion 420 of the aerosol generating article 400. More specifically, the heating element 11 may be arranged to cover at least a portion of the carrier 421. The heating element 11 may be arranged to completely cover the carrier 421.

According to an embodiment, the heating element 11 may be arranged to cover only a portion of the carrier 421 in which case a portion of the carrier 421 may be directly heated by the heating element 11 and the rest portions of the carrier 421 may be indirectly heated. For example, the rest portions of the carrier 421 may be heated indirectly by receiving heat through a thermally conductive wrapper. However, embodiments of the present disclosure are not limited thereto.

According to another aspect of the present disclosure, a system generates an aerosol by heating the aerosol generating article 400 using the aerosol generating device 10.

Here, the aerosol generating article 400 includes: a first portion 410 including a mouthpiece portion; and the second portion 420 that is arranged adjacent to the first portion 410 and includes the capsule C, wherein the capsule C may include a core region, a first shell, and a second shell, and the core region of the capsule C may include nicotine and an aerosol generating material. The aerosol generating device 10 may heat at least a portion of the second portion 420 to generate an aerosol.

With respect to another aspect of the present disclosure, the descriptions given with respect to the one aspect of the present disclosure may be applied in the same manner, and when descriptions with respect to another aspect of the present disclosure are omitted, descriptions given with respect to the one aspect of the present disclosure are applied in the same manner.

According to an embodiment, the aerosol generating device 10 may generate an aerosol by heating at least a portion of the second portion 420 after the capsule C is crushed.

Figure 8:
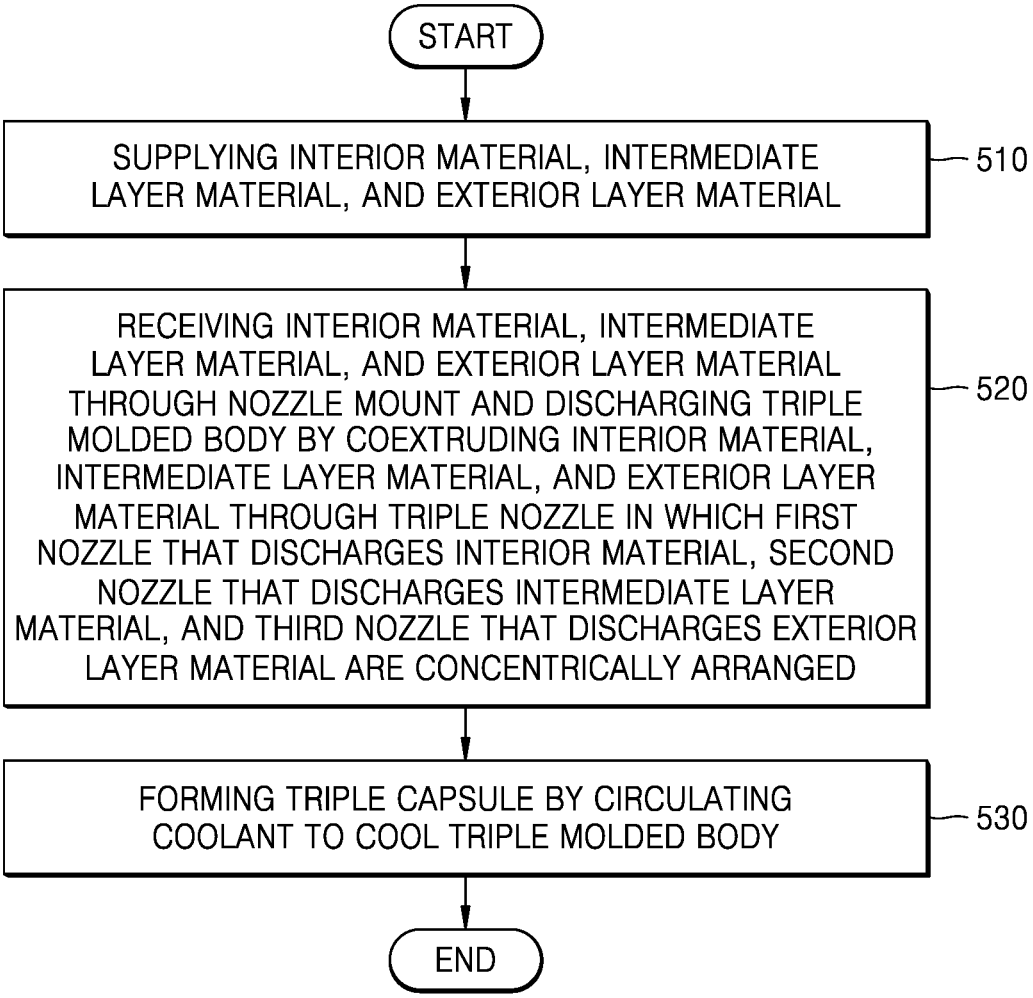
FIG. 8 is a flowchart of a method of manufacturing a triple capsule, according to an embodiment.

FIG. 8 is a flowchart of a method of manufacturing a triple capsule, according to an embodiment.

According to another aspect of the present disclosure, a method of manufacturing a triple capsule includes:

(a) supplying an interior material, an intermediate layer material, and an exterior layer material, in operation 510;

(b) receiving the interior material, the intermediate layer material, and the exterior layer material through a nozzle mount and discharging a triple molded body by coextruding the interior material, the intermediate layer material, and the exterior layer material through a triple nozzle in which a first nozzle that discharges the interior material, a second nozzle that discharges the intermediate layer material, and a third nozzle that discharges the exterior layer material are concentrically arranged, in operation 520; and (c) forming the triple capsule by circulating a coolant to cool the triple molded body, in operation 530.

With respect to another aspect of the present disclosure, the descriptions given with respect to another aspect of the present disclosure may be applied in the same manner, and when descriptions with respect to another aspect of the present disclosure are omitted, descriptions given with respect to another aspect of the present disclosure are applied in the same manner.

Coextrusion may refer to a process of simultaneously extruding a plurality of materials to shape an assembly made of the plurality of materials. The interior material, the intermediate layer material, and the exterior layer material may be coextruded by a molding portion and accordingly, a triple molded body including the interior material, the intermediate layer material and the exterior layer material may be produced from the molding portion.

According to an embodiment, the core region of the capsule C described above may include the interior material, the first shell may include the intermediate layer material, and the second shell may include the exterior layer material. For example, the intermediate layer material may include a fat-soluble wax having a melting point of 30° C. to 60° C., and the exterior layer material may include a water-soluble polymer having a gelation temperature of 40° C. to 55° C.

Referring to FIG. 8, the method of manufacturing the triple capsule may include operations 510 to 530. However, other general-purpose operations other than the operations illustrated in FIG. 8 may be further included in the method of manufacturing the triple capsule.

Figure 9:
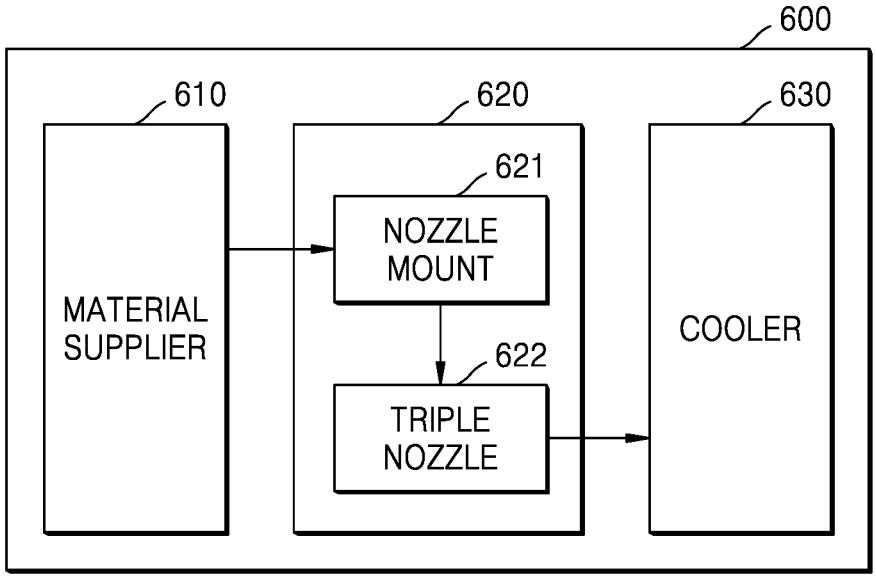
FIG. 9 is a schematic diagram illustrating a configuration of a device for manufacturing a triple capsule, according to an embodiment.

The method of manufacturing the triple capsule of FIG. 8 may include operations executed in a time series in a device for manufacturing a triple capsule of FIG. 9.

A device may supply the interior material, the intermediate layer material, and the exterior layer material, in operation 510.

The device may receive the interior material, the intermediate layer material, and the exterior layer material through the nozzle mount and discharge the triple molded body by coextruding the interior material, the intermediate layer material, and the exterior layer material through the triple nozzle in which the first nozzle that discharges the interior material, the second nozzle that discharges the intermediate layer material, and the third nozzle that discharges the exterior layer material are concentrically arranged, in operation 520.

The device may form the triple capsule by circulating the coolant to cool the triple molded body, in operation 530.

FIG. 9 is a schematic diagram illustrating a configuration of a device 600 for manufacturing a triple capsule, according to an embodiment.

Referring to FIG. 9, the device 600 for manufacturing the triple capsule may include a material supplier 610, a molding portion 620, and a cooler 630. However, embodiments of the present disclosure are not limited thereto. Other general-purpose components may further be included in the device 600.

The material supplier 610 may supply an interior material, an intermediate layer material, and an exterior layer material. The material supplier 610 may supply the interior material, the intermediate layer material, and the exterior layer material included in the triple capsule to the molding portion 620.

The material supplier 610 may include a storage means, a connection means, and a transport means to supply the interior material, the intermediate layer material, and the exterior layer material to the molding portion 620. The material supplier 610 may include a means to store the interior material, the intermediate layer material, and the exterior layer material, a means to connect the material supplier 610 to the molding portion 620, and a means to transport the interior material, the intermediate layer material, and the exterior layer material to the molding portion 620.

Each of the storage means, connection means, and transport means of the material supplier 610 may be provided in the material supplier 610 as a single unit, but each of the storage means, connection means, and transport means may be provided in the material supplier 610 as a plurality of units corresponding to the interior material, the intermediate layer material, and the exterior layer material.

The molding portion 620 may coextrude the interior material, the intermediate layer material, and the exterior layer material. A triple molded body including the interior material, the intermediate layer material, and the exterior layer material may be discharged from the molding portion 620 by coextruding the interior material, the intermediate layer material, and the exterior layer material.

The molding portion 620 may include a nozzle mount that receives the interior material, the intermediate layer material, and the exterior layer material, and a triple nozzle in which a first nozzle that discharges the interior material, a second nozzle that discharges the intermediate layer material, and a third nozzle that discharges the exterior layer material are concentrically arranged. Detailed descriptions of components constituting the molding portion 620 will be described later with reference to FIG. 10.

The cooler 630 may form the triple capsule by circulating a coolant to cool the triple molded body. The coolant may be circulated through a path including the molding portion 620 by the cooler 630. Accordingly, the triple molded body may be circulated according to the flow of the coolant as soon as the triple molded body is discharged from the molding portion 620, in which process, the triple molded body may be cooled to form the triple capsule.

The cooler 630 may include the storage means, the connection means, and the transport means to circulate the coolant. The cooler 630 may include the storage means to store the coolant, the connection means to form a circulation path between the storage means and the molding portion 620, and the transport means to circulate the coolant along the circulation path.

Figure 10:
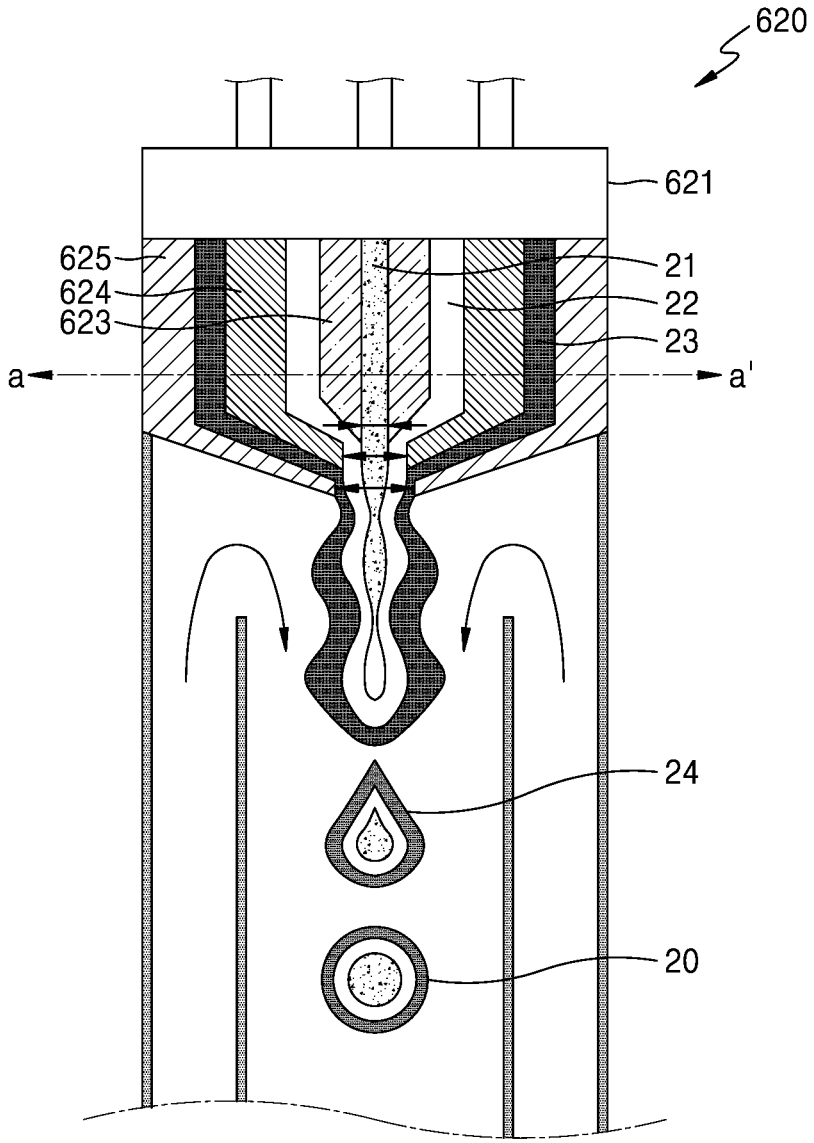
FIG. 10 is a diagram illustrating a structure of a molding portion for performing coextrusion, according to an embodiment.

FIG. 10 is a detailed diagram showing a structure of the molding portion 620 for performing coextrusion, according to an embodiment.

Referring to FIG. 10, the molding portion 620 may include a nozzle mount 621 and a triple nozzle 622. Other general-purpose components other than the nozzle mount 621 and the triple nozzle 622 may be further included in the molding portion 620, if necessary.

The nozzle mount 621 may receive an interior material 21, an intermediate layer material 22, and an exterior layer material 23 from a material supplier (now shown). A connection means of the material supplier may be connected to the nozzle mount 621, and the nozzle mount 621 may accommodate the interior material 21, the intermediate layer material 22, and the exterior layer material 23 transferred by a transport means of the material supplier.

The nozzle mount 621 may be bonded to the triple nozzle 622 to form the molding portion 620. The nozzle mount 621 may convey the transferred the interior material 21, the intermediate layer material 22, and the exterior layer material 23 to the triple nozzle 622. The nozzle mount 621 may be located higher than the triple nozzle 622 so as to more smoothly supply the interior material 21, the intermediate layer material 22, and the exterior layer material 23 to the triple nozzle 622 than before. However, embodiments of the present disclosure are not limited thereto.

The nozzle mount 621 may have a cylindrical shape. When the nozzle mount 621 has a cylindrical shape, the interior material 21, the intermediate layer material 22, and the exterior layer material 23 may be delivered to the triple nozzle 622 that is contacted through a bottom surface. Still, in addition to the cylindrical shape, the nozzle mount 621 may have another shape that may be transferred through the interior material 21, the intermediate layer material 22, and the exterior layer material 23 between a material transfer portion and the triple nozzle 622.

The triple nozzle 622 may have a shape in which a first nozzle 623 that discharges the interior material 21, a second nozzle 624 that discharges the intermediate layer material 22, and a third nozzle 625 that discharges the exterior layer material 23 are concentrically arranged. The first nozzle 623, the second nozzle 624, and the third nozzle 625 may be formed in a nozzle structure to eject a fluid to the outside. The triple nozzle 622 may discharge materials transferred from the material supplier and the nozzle mount 621 to the cooler 630 through an outlet having a small cross-sectional area.

The fact that the first nozzle 623, the second nozzle 624, and the third nozzle 625 are concentrically arranged may refer to that a position at which the interior material 21 is discharged from the first nozzle 623, a position at which the intermediate layer material 22 is discharged from the second nozzle 624, and a position at which the exterior layer material 23 is discharged from the third nozzle 625 are identical to each other. The fact that the first nozzle 623, the second nozzle 624, and the third nozzle 625 are concentrically arranged as illustrated in FIG. 10 may also refer to that outlets from which the interior material 21, the intermediate layer material 22, and the exterior layer material 23 are discharged are arranged in a row along a direction orthogonal to the ground.

An outlet of the first nozzle 623, an outlet of the second nozzle 624, and an outlet of the third nozzle 625 may have a circular cross section. As a cross section of the outlets of the first nozzle 623, the second nozzle 624, and the third nozzle 625 has a circular shape, a cross section of a triple molded body 24 discharged from the triple nozzle 622 may have a circular shape. Accordingly, a triple capsule 20 may have a spherical shape. Still, the cross section of the outlets of the triple nozzle 622 is not limited to a circular shape, and the cross section of the outlets of the triple nozzle 622 may have a shape corresponding to various shapes of the triple molded body 24 and the triple capsule 20.

The triple molded body 24 may refer to a mixture in which the interior material 21, the intermediate layer material 22, and the exterior layer material 23 are combined to each other. Alternatively, the triple molded body 24 may be an intermediate material in a process in which the interior material 21, the intermediate layer material 22, and the exterior layer material 23 are formed into the triple capsule 20. When the triple molded body 24 is cooled by the cooler 630, the triple capsule 20 may be formed.

The outlets of the first nozzle 623, the second nozzle 624, and the third nozzle 625 may have diameters different from each other. For example, a diameter of the outlet of the second nozzle 624 that discharges the intermediate layer material 22 may be larger than a diameter of the outlet of the first nozzle 623 that discharges the interior material 21, and a diameter of the outlet of the third nozzle 625 that discharges the exterior layer material 23 may be larger than the diameter of the outlet of the second nozzle 624 that discharges the intermediate layer material 22. Therefore, a structure of the triple capsule 20 in which the exterior layer material 23 surrounds the intermediate layer material 22 that surrounds the interior material 21 may be implemented. Still, when the structure of the triple capsule 20 is changed, a structure of the triple nozzle 622 may also be changed.

A standard of the triple nozzle 622 may be set to implement a standard of the triple capsule 20. For example, the diameters of the outlets of the first nozzle 623, the second nozzle 624, and the third nozzle 625 may be set to values that may implement a standard for diameters of the interior material 21, the intermediate layer material 22, and the exterior layer material 23 that form the triple capsule 20. For example, the diameter of the outlet of the first nozzle 623 may be 1.0 mm or more and 3.0 mm or less, the diameter of the outlet of the second nozzle 624 may be larger than the diameter of the outlet of the first nozzle 623 by 0.5 mm or more and 2.5 mm or less, and the diameter of the outlet of the third nozzle 625 may be larger than the diameter of the outlet of the second nozzle 624 by 1.0 mm or more and 3.0 mm or less. Still, when a design of a size of the triple capsule 20 is changed, a size of the triple nozzle 622 may also be changed, accordingly.

As described above, the interior material 21 may be a water-soluble material, the intermediate layer material 22 may be a fat-soluble material, and the exterior layer material 23 may be a water-soluble material. A coolant circulating through the cooler 630 may be a fat-soluble material. According to such physical properties, the interior material 21, the intermediate layer material 22, and the exterior layer material 23 within the triple molded body 24 discharged from the triple nozzle 622 may form layers that do not mix with the coolant. As the coolant circulates, the triple molded body 24 may be cooled while moving along a circulation path together with the coolant in a layered state in which process the intermediate layer material 22 and the exterior layer material 23 may form a closed curved surface by attraction between water-soluble materials and attraction between fat-soluble materials, thereby forming the triple capsule 20 that carries the interior material 21 therein.

According to an embodiment in which the triple molded body 24 is cooled by the coolant to form the triple capsule 20, when a melting point of a fat-soluble wax used as the intermediate layer material 22 is about 30° C. and a gelation temperature of a water-soluble polymer used as the exterior layer material 23 is about 50° C., the triple molded body 24 may move along the circulation path together with the coolant, forming a second shell first, and then may be changed to the triple capsule 20, forming a first shell.

As another example, when the melting point of the fat-soluble wax used as the intermediate layer material 22 is about 60° C. and the gelation temperature of the water-soluble polymer used as the exterior layer material 23 is about 50° C., the triple molded body 24 may move along the circulation path together with the coolant, forming the first shell first, and then may be changed to the triple capsule 20, forming the second shell.

Depending on the two cases, an order in which the first shell and the second shell of the triple capsule 20 are formed may be different, but the melting point of the intermediate layer material 22 and the gelation temperature of the exterior layer material 23 are close to each other. Therefore, the first shell and the second shell may be formed together with relatively no time difference by the coolant. Therefore, the durability of the triple capsule 20 may be increased, and the manufacturing yield may also be increased.

In order for the triple capsule 20 to be stably formed in the process in which the triple molded body 24 circulates along the coolant within the cooler 630, the outlets of the triple nozzle 622 need to have appropriate diameters. When the outlets of the triple nozzle 622 have excessively large diameters, the intermediate layer material 22 and the exterior layer material 23 may be closed, and a time required for cooling and stabilizing may increase, thereby reducing the yield of the triple capsule 20. On the other hand, when the outlets of the triple nozzle 622 have excessively small diameters, layers formed by the triple molded body 24 in the coolant are unable to form a thickness of a certain level or higher, so that the triple molded body 24 may be physically scattered by the circulation flow of the coolant.

Therefore, the triple capsule 20 may be stably formed within the cooler 630 only when the outlets of the triple nozzle 622 are formed with appropriate diameters. As in the above example, when the diameter of the outlet of the first nozzle 623 is within a range of about 1.0 mm or more and about 3.0 mm or less, the diameter of the outlet of the second nozzle 624 is within a range of about 1.5 mm or more and about 5.5 mm or less, and the diameter of the outlet of the third nozzle 625 is within a range of about 2.5 mm or more and about 8.5 mm or less, the triple molded body 24 may be effectively separated into the respective layers of the interior material 21, the intermediate layer material 22 and the exterior layer material 23. Thus, the manufacturing yield of the triple capsule 20 may be increased.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating article comprising an aerosol generating material, comprising:

a first portion comprising a mouthpiece portion;

a second portion that is arranged adjacent to the first portion and comprises a capsule, and a carrier arranged within the second portion and arranged adjacent to the capsule, and a third portion arranged adjacent to the second portion, the third portion is arranged at an extreme end of the aerosol generating article as a tube-shaped plug;

wherein the capsule comprises a core region, a first shell, and a second shell, wherein the core region of the capsule consists of nicotine and the aerosol generating material, and optionally an organic acid, wherein the capsule and the carrier are arranged side by side, the capsule is arranged adjacent to the third portion, the carrier is arranged adjacent to the first portion, and the second portion is heated by a heating element arranged to cover at least a portion of the second portion, and wherein the nicotine and the aerosol generating material contained in the core region of the capsule leak out and flow into the carrier after the capsule is crushed, and the carrier is heated by the heating element to generate aerosol.

2. The aerosol generating article of claim 1, wherein, the capsule is formed in a triple structure of the core region, the first shell, and the second shell in order from the inside, the first shell comprises a fat-soluble wax, and the second shell comprises a water-soluble polymer.

3. The aerosol generating article of claim 1, wherein the first shell comprises a fat-soluble wax having a melting point of 30° C. to 60° C., and the second shell comprises a water-soluble polymer having a gelation temperature of 40° C. to 55° C.

4. The aerosol generating article of claim 1, wherein the first shell comprises one or more of carnauba wax, candelilla wax, castor wax, feather palm wax, cocoa butter, and shea butter, and the second shell comprises gelatin, agar, carrageenan, gellan gum, pectin, starch, or alginate.

5. The aerosol generating article of claim 1, wherein the core region has a diameter of 2.5 mm to 6.0 mm, the first shell has a thickness of 0.1 mm to 1.0 mm, and the second shell has a thickness of 0.001 mm to 1.5 mm.

6. The aerosol generating article of claim 1, wherein the core region consists of 30 parts to 70 parts by weight of propylene glycol, 30 parts to 70 parts by weight of glycerin, and 0.1 parts to 5 parts by weight of nicotine, based on 100 parts by weight of a total composition.

7. The aerosol generating article of claim 1, wherein the capsule has a diameter of 2.6 mm to 8.5 mm, and the capsule has a crushing strength of 0.5 kgf to 3.0 kgf.

8. A method for manufacturing a triple capsule contained in the aerosol generating article according to claim 1, the method comprising:

(a) supplying an interior material, an intermediate layer material, and an exterior layer material;

(b) receiving the interior material, the intermediate layer material, and the exterior layer material through a nozzle mount and discharging a triple molded body by coextruding the interior material, the intermediate layer material, and the exterior layer material through a triple nozzle in which a first nozzle that discharges the interior material, a second nozzle that discharges the intermediate layer material, and a third nozzle that discharges the exterior layer material are concentrically arranged; and (c) forming the triple capsule by circulating a coolant to cool the triple molded body, wherein the intermediate layer material comprises a fat-soluble wax having a melting point of 30° C. to 60° C., and the exterior layer material comprises a water-soluble polymer having a gelation temperature of 40° C. to 55° C.

9. A system for generating an aerosol by heating an aerosol generating article using an aerosol generating device, wherein the aerosol generating article comprises:

a first portion comprising a mouthpiece portion;

a second portion that is arranged adjacent to the first portion and comprises a capsule, and a carrier arranged within the second portion and arranged adjacent to the capsule, and a third portion arranged adjacent to the second portion, the third portion is arranged at an extreme end of the aerosol generating article as a tube-shaped plug;

wherein the capsule comprises a core region, a first shell, and a second shell, wherein the core region of the capsule consists of nicotine and an aerosol generating material, and optionally an organic acid, wherein the capsule and the carrier are arranged side by side, the capsule is arranged adjacent to the third portion, the carrier is arranged adjacent to the first portion, and the second portion is heated by a heating element arranged to cover at least a portion of the second portion, and wherein the nicotine and the aerosol generating material contained in the core region of the capsule leak out and flow into the carrier after the capsule is crushed, and the carrier is heated by the heating element to generate aerosol.

* * * * *